US008978753B2

(12) United States Patent
Ford

(10) Patent No.: US 8,978,753 B2
(45) Date of Patent: Mar. 17, 2015

(54) CYCLONIC STRAINER

(76) Inventor: Michael Brent Ford, St. George, UT (US)

( * ) Notice: Subject to any disclaimer, the term of this patent is extended or adjusted under 35 U.S.C. 154(b) by 359 days.

(21) Appl. No.: 12/874,876

(22) Filed: Sep. 2, 2010

(65) Prior Publication Data

US 2011/0100624 A1 May 5, 2011

Related U.S. Application Data

(60) Provisional application No. 61/240,476, filed on Sep. 8, 2009.

(51) Int. Cl.
*E21B 43/38* (2006.01)

(52) U.S. Cl.
CPC ..... *E21B 43/38* (2013.01)
USPC ..... 166/105.5; 166/265; 166/233

(58) Field of Classification Search
CPC ..... E21B 43/38; E21B 43/121; E21B 43/128; E21B 43/12; E21B 43/088; E21B 43/086
USPC ..... 166/265, 105.5, 231, 233
See application file for complete search history.

(56) References Cited

U.S. PATENT DOCUMENTS 2,517,198 A * 8/1950 Gilbert ..... 166/105.5
4,074,763 A * 2/1978 Stevens ..... 166/325
4,666,476 A * 5/1987 Reeve et al. ..... 96/216
6,257,333 B1 * 7/2001 Mann et al. ..... 166/265
6,322,616 B1 * 11/2001 Kennedy et al. ..... 96/208
7,428,923 B2 * 9/2008 Ford ..... 166/105.3
7,703,509 B2 * 4/2010 Ford ..... 166/105.5
7,713,035 B2 * 5/2010 Ford ..... 417/430
7,909,092 B2 * 3/2011 Cobb ..... 166/105.1
8,051,907 B2 * 11/2011 Cobb ..... 166/105.1
2008/0210417 A1 * 9/2008 Ford ..... 166/105.5
2010/0294731 A1 * 11/2010 Ford ..... 210/768

* cited by examiner

*Primary Examiner* — Nicole Coy
(74) *Attorney, Agent, or Firm* — Weis & Moy, P.C; Veronica-Adele R. Cao; Jeffrey D. Moy

(57) ABSTRACT

A cyclonic strainer for a well intake that provides for improved separation of gas and fluid in naturally flowing wells during mechanical pumping operations. The strainer includes an elongated member having a channel formed longitudinally therein. A plurality of apertures extend through the elongated member angled downwardly into the channel and away from a center of the channel allowing for a better shear between gas and fluids. The angle of the ports causes fluid to be forced in an opposite direction, resulting in gases and fluids shearing more quickly and cleanly, due to kinetic energy. The angle of the ports can be varied to accommodate different conditions in various well environments. In well environments in which gaseous conditions are extreme, it can be desired for the ports to be sloped southwardly or downwardly at a greater angle than for well environments in which gaseous conditions are not as extreme.

15 Claims, 6 Drawing Sheets

CYCLONIC STRAINER

REFERENCE TO RELATED APPLICATIONS

This application claims priority to U.S. Provisional Application Ser. No. 61/240,476 titled CYCLONIC NIPPLE DEVICE FOR A WELL INTAKE which was filed on Sep. 8, 2009 by Michael Brent Ford and is hereby incorporated in its entirety.

TECHNICAL FIELD

The present application relates generally to fluid and gas well apparatuses and, more particularly, to a cyclonic strainer for a well intake that provides for improved separation of gas and fluid in naturally flowing wells during mechanical pumping operations.

BACKGROUND

In completed fluid and gas wells, the wellbore can be lined with piping known as tubing. The tubing can extend from the bottom of the wellbore and be opened to the earth's surface. In a naturally flowing well, formation pressure typically forces fluid and gas through the tubing, bringing it to the surface. The natural pressure in a completed well eventually diminishes, however, and when this occurs, pumping systems can be installed in the tubing to mechanically remove oil or other fluid from beneath the earth's surface.

An oil well pumping system begins with an above-ground pumping unit, which is commonly referred to as a "pumpjack," "nodding donkey," "horsehead pump," "beam pump," "sucker rod pump," and the like. The pumping unit can create a reciprocating up and down pumping action that moves the oil or other substance being pumped out of the ground and into a flow line, from which the oil is then taken to a storage tank or other such structure.

A string of sucker rods is inserted into the tubing, which ultimately can be indirectly coupled at its north end to the above-ground pumping unit. The string of sucker rods can be coupled at its south end to a subsurface pump that is located at or near the fluid in the oil well. The subsurface pump has a number of basic components, including a barrel and a plunger. The plunger operates within the barrel, and the barrel, in turn, is positioned within the tubing. It is common for the barrel to include a standing valve and the plunger to include a traveling valve. The standing valve can have a ball therein for the purpose of regulating the passage of oil from down-hole into the pump, allowing the pumped matter to be moved northward out of the system and into the flow line, while preventing the pumped matter from dropping back southward into the hole. Oil can be permitted to pass through the standing valve and into the pump by the movement of the ball off its seat, and oil is prevented from dropping back into the hole by the seating of the ball.

South of the standing valve are a number of basic components, typically including such items as a seating nipple and a strainer or gas anchor, as well as other components. North of the standing valve, coupled to the sucker rods, can be the traveling valve. The traveling valve can regulate the passage of oil from within the pump northward in the direction of the flow line, while preventing the pumped oil from dropping back southward, in the direction of the standing valve and hole.

Oil can be pumped from a hole through a series of downstrokes and upstrokes of the pump when motion is imparted by the above-ground pumping unit. During the upstroke, formation pressure causes the ball in the standing valve to move upward, allowing the oil to pass through the standing valve and into the barrel of the oil pump. This oil can be held in place between the standing valve and the traveling valve. In the traveling valve, the ball can be located in the seated position, held there by the pressure from the oil that has been previously pumped.

On the downstroke, the ball in the traveling valve unseats, permitting the oil that has passed through the standing valve to pass therethrough. Also during the downstroke, the ball in the standing valve seats, preventing pumped oil from moving back down into the hole. The process repeats itself again and again, with oil essentially being moved in stages from the hole, to above the standing valve and in the oil pump, to above the traveling valve and out of the oil pump. As the oil pump fills, the oil passes through the pump and into the tubing. As the tubing is filled, the oil passes into the flow line, and is then taken to the storage tank or other such structure.

A number of problems can occur with fluid and gas production from wells. Fluid that is pumped from the ground typically includes solid impurities, as well as water and gas. With respect to naturally flowing wells, when relatively large volumes of water or other fluid enter the formation, the weight of this fluid can create a plug effect in the tubing, thereby slowing down or even prematurely shutting off the flow of gas to the surface. In order to continue gas flow, mechanical means, such as a pumping system, would then be required.

Furthermore, once the natural pressure in the well has depleted and a pumping system is employed to remove the subterranean fluid and gas, other problems can occur. When the pumping system is actuated, fluid and gas migrate from the wellbore to the pumping system's intake, which comprises an area of relatively lower pressure than that of the formation. Gas that enters the pumping system can cause a condition known as "gas lock," and can slow down or even shut down production. Intake areas of pumping systems generally include nipple or strainer devices to help control the amount of gas that enters the pumping system. Often, however, gas is still allowed to enter, such that the intake of fluid is substantially reduced or even halted resulting in undesired affects.

The present application addresses these issues encountered in fluid and gas production and provides other, related, advantages.

SUMMARY

This summary is provided to introduce a selection of concepts in a simplified form that are further described below in the DESCRIPTION OF THE APPLICATION. This summary is not intended to identify key features of the claimed subject matter, nor is it intended to be used as an aid in determining the scope of the claimed subject matter.

In accordance with one embodiment of the present application, a cyclonic strainer is provided. The cyclonic strainer can include an elongated member having a channel formed longitudinally therein. In addition, the cyclonic strainer can include a plurality of apertures extending through the elongated member angled downwardly into the channel and away from a center of the channel.

In accordance with another embodiment of the present application, a method for controlling gas from entering into a pump system is provided. The method can include providing a cyclonic strainer comprising: an elongated member having a channel formed longitudinally therein; and a plurality of apertures extending through said elongated member angled downwardly into said channel and away from a center of said channel; coupling said cyclonic strainer to a subsurface pump; utilizing said subsurface pump, pumping fluid; and centrifuging said fluid against an interior wall of said strainer and allowing gas to be driven through a center of said strainer with said gas being diverted northward to a surface.

In accordance with yet another embodiment of the present application, an apparatus is provided. The apparatus can include a cylinder with a channel formed therein. In addition, the apparatus can include a tubing string coupled to a north end of the cylinder. The apparatus can also include a plurality of ports on a body of the cylinder angled southward to the channel in a direction away from a center of the channel. The apparatus can include a tail pipe coupled to a south end of the cylinder.

BRIEF DESCRIPTION OF DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The application itself, however, as well as a preferred mode of use, further objectives and advantages thereof, can be best understood by reference to the following detailed description of illustrative embodiments when read in conjunction with the accompanying drawings, wherein:

DESCRIPTION OF THE APPLICATION

Figure 1:
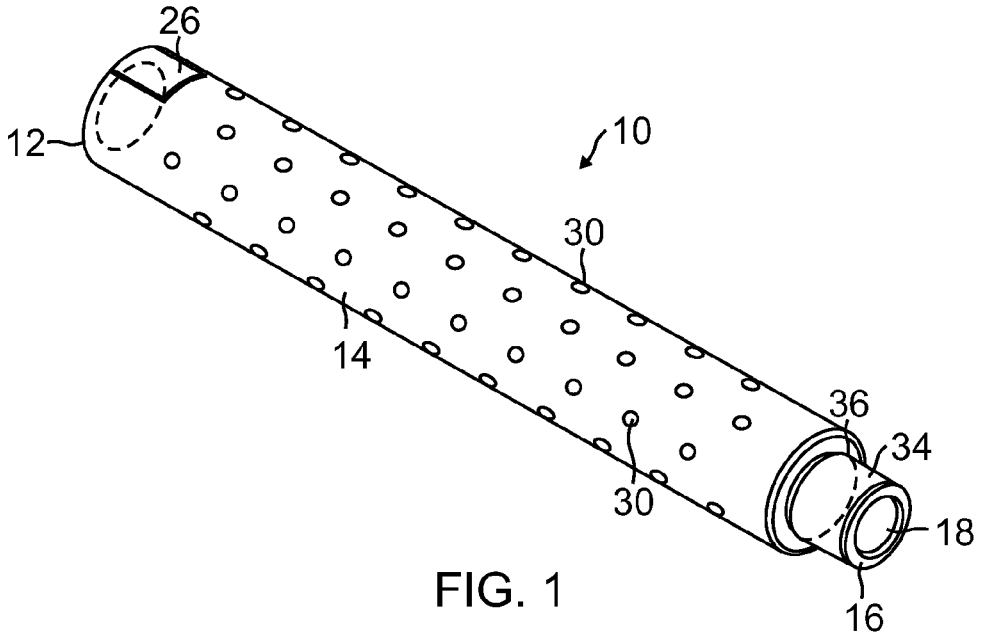
FIG. 1 is a perspective view of an exemplary cyclonic strainer, in accordance with an embodiment of the present application.
Figure 2:
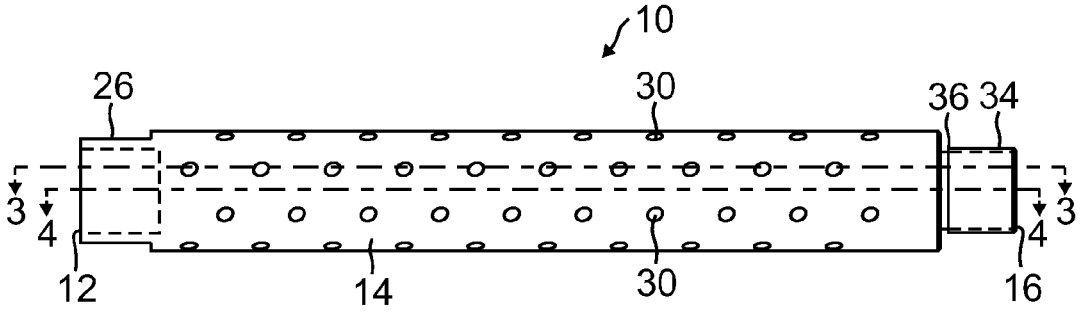
FIG. 2 is a side view of the exemplary cyclonic strainer of FIG. 1.

The foregoing description is provided to enable any person skilled in the relevant art to practice the various embodiments described herein. Various modifications to these embodiments can be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

The present application relates to a cyclonic strainer for a well intake that provides for improved separation of gas and fluid. The strainer can include an elongated member having a channel formed longitudinally therein. A plurality of apertures can extend through the elongated member angled downwardly into the channel and away from a center of the channel allowing for a better shear between gas and fluids. The angle of the ports can cause fluid to be forced in an opposite direction, resulting in gases and fluids shearing more quickly and cleanly, due to kinetic energy. The angle of the ports can be varied to accommodate different conditions in various well environments. In well environments in which gaseous conditions are extreme, it can be desired for the ports to be sloped southwardly or downwardly at a greater angle than for well environments in which gaseous conditions are not as extreme.

Turning now to FIGS. 1-4, a cyclonic strainer device ("cyclonic strainer 10") consistent with an embodiment of the present application is shown. In describing the structure of the cyclonic strainer 10 and its operation, the terms "north" and "south" are utilized. The term "north" is intended to refer to that end of the cyclonic strainer 10 that is more proximate the pumping unit, while the term "south" is intended to refer to that end of the cyclonic strainer 10 that is more distal the pumping unit, or "down hole." Furthermore, while strainer and/or nipple 10 are used herein, those skilled in the relevant art will appreciate that other terms can be interchanged and are within the scope of this application.

The cyclonic strainer 10 generally includes a substantially cylindrical shaped device having a north end 12, a body 14, a south end 16, and a longitudinal channel 18 running therethrough. The cyclonic strainer 10 can be constructed of various lengths, as can be desired for various well configurations and conditions. The body 14 of the cyclonic strainer 10 can include an exterior wall 20 and an interior wall 22. The cyclonic strainer 10 is preferably a one-piece structure, although it can be desired for various components of the cyclonic strainer 10 to be separate pieces that can be coupled together to form a one-piece unit. The cyclonic strainer 10 is preferably composed of a hardened material capable of withstanding conditions present in typical well environments. In a preferred embodiment, the cyclonic strainer 10 is composed of brass. However, other suitable materials can be used for the cyclonic strainer 10.

Figure 14:
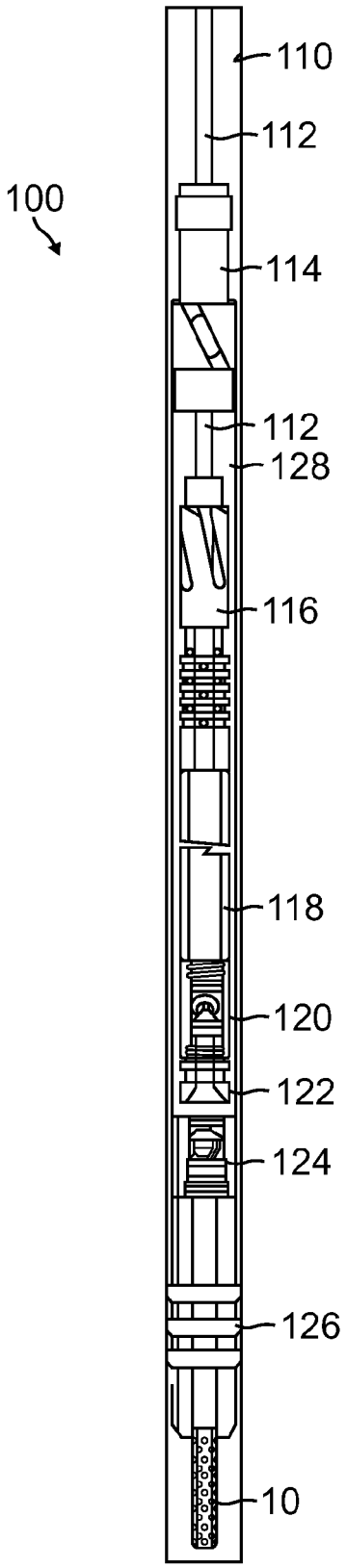
FIG. 14 is a side view of an embodiment of an exemplary pumping apparatus having the exemplary cyclonic strainer of the present application positioned thereon.

In one embodiment, the cyclonic strainer 10 is adapted to be coupled at its north end 12 to a southern portion of a subsurface pump 100 as shown in FIG. 14, for example, and further discussed below. In such an embodiment, the cyclonic strainer 10 thus forms an intake area. In one embodiment, threading 24 is provided proximate the north end 12 of the cyclonic strainer 10 for coupling to the subsurface pump 100.

However, any other suitable coupling means known in the relevant art can be employed for coupling the cyclonic strainer 10 to a subsurface pump. While in this embodiment threading 24 is provided at an interior diameter of the cyclonic strainer 10, it can be desired to provide threading at an exterior diameter of the cyclonic strainer 10. In this embodiment, wrench flats 26 are included at the north end 12 of the cyclonic strainer 10, to assist with coupling the cyclonic strainer 10 to a subsurface pump. However, it would be possible to construct a cyclonic strainer 10 with the wrench flats 26 omitted.

Figure 3:
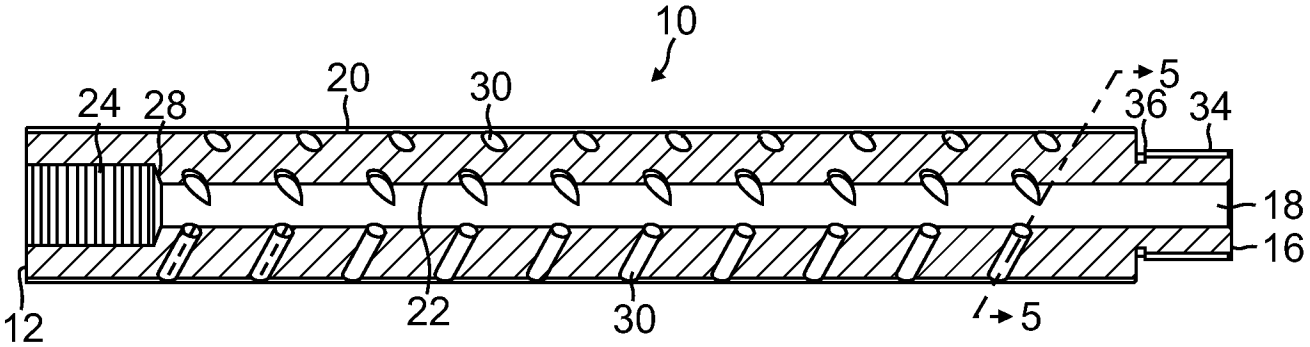
FIG. 3 is a cross-sectional view of the exemplary cyclonic strainer, taken through line 3-3 of FIG. 2.
Figure 4:
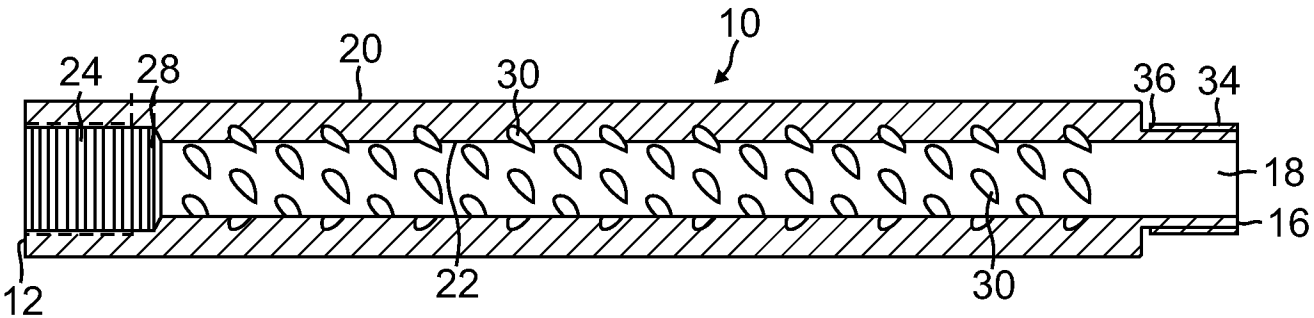
FIG. 4 is a cross-sectional view of the exemplary cyclonic strainer, taken through line 4-4 of FIG. 2.

A shoulder 28 can also be included proximate the north end 12. In this embodiment, as shown in FIG. 3, for example the shoulder 28 can be positioned southward of threading 24. When the cyclonic strainer 10 is positioned on the subsurface pump 100, the shoulder 28 abuts a southern portion of the seating strainer section 126, thereby rendering a tight fit of cyclonic strainer 10 on the subsurface pump 100.

The body 14 of the cyclonic strainer 10 can include a plurality of ports 30, each of which communicates from the exterior of the cyclonic strainer 10 to the channel 18. Ports 30 can also be referred to as openings, holes, gaps, apertures, etc. The body 14 of the cyclonic strainer 10 can have virtually any number of ports 30, as can be desired for various well configurations and conditions. In one embodiment, the ports 30 are evenly spaced around the cyclonic strainer 10 vertically and/or horizontally. Preferably, from the perspective of the exterior of the cyclonic strainer 10, each port 30 can be angled southwardly or downwardly from the exterior of the cyclonic strainer 10 to the channel 18 in a direction away from a center 32 of the channel 18 of the cyclonic strainer 10 as shown in FIGS. 6 and 7.

In one embodiment, each port 30 can slope downwardly at an angle of up to sixty (60) degrees. Likewise, from the perspective of the channel 18, each port 30 is preferably angled northwardly or upwardly from the channel 18 to the exterior of the cyclonic strainer 10. In another embodiment, each port 30 can slope southwardly or downwardly at an angle ranging from zero (0) up to and including sixty (60) degrees. Such an orientation of the ports 30 allows for a better shear between gas and fluids. In this regard, due to a variety of factors including gravity and the heavier weight of the fluids compared to gas, the gas naturally tends to float upward. The angle of the ports 30 causes fluid to be forced in the opposite direction, resulting in gases and fluids shearing more quickly and cleanly, due to kinetic energy. The angle of the ports 30 could be varied to accommodate different conditions in various well environments, depending upon the nature and severity of any gaseous conditions that can be present. In well environments in which gaseous conditions are extreme, for example, it can be desired for the ports 30 to be sloped southwardly or downwardly at a greater angle than for well environments in which gaseous conditions are not as extreme. By having a greater angle, gases are prevented from escaping back through the ports 30.

Figure 5:
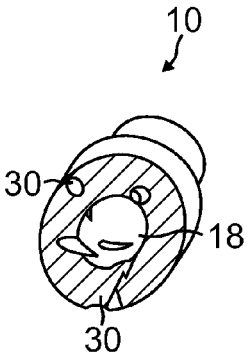
FIG. 5 is a cross-sectional view of the exemplary cyclonic strainer, taken through line 5-5 of FIG. 3.
Figure 6:
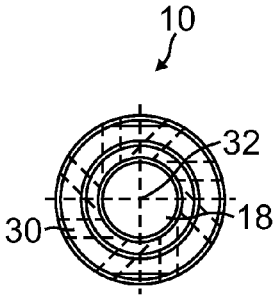
FIG. 6 is a top view of the exemplary cyclonic strainer of FIG. 1, with ports thereof shown in phantom.
Figure 7:
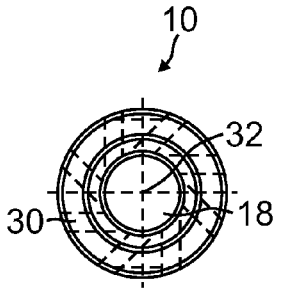
FIG. 7 is a bottom view of the exemplary cyclonic strainer of FIG. 1, with ports thereof shown in phantom.
Figure 8:
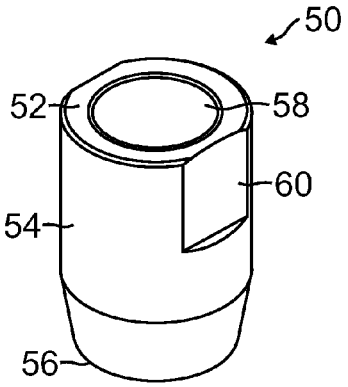
FIG. 8 is a perspective view of an exemplary plug component to be utilized with the cyclonic nipple device, in accordance with an embodiment of the present application.
Figure 9:
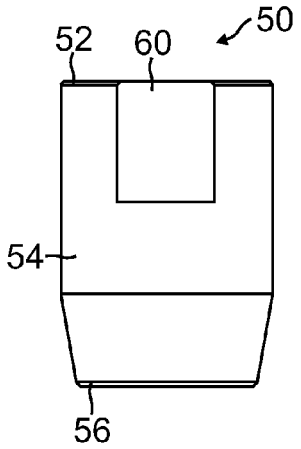
FIG. 9 is a side view of the exemplary plug component of FIG. 8.
Figure 10:
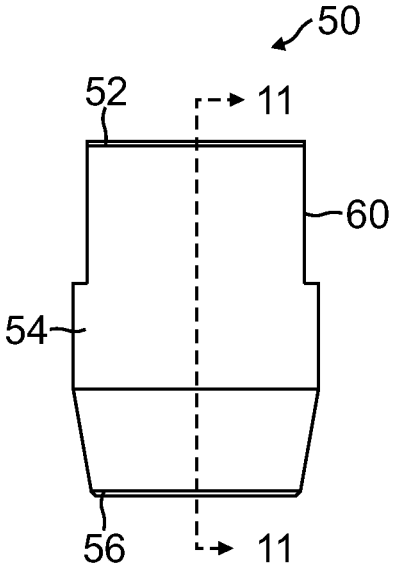
FIG. 10 is another side view of the exemplary plug component of FIG. 8.
Figure 11:
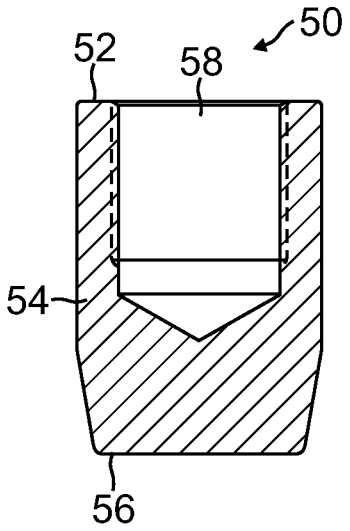
FIG. 11 is a cross-sectional view of the exemplary plug component, taken through line 11-11 of FIG. 10.
Figure 12:
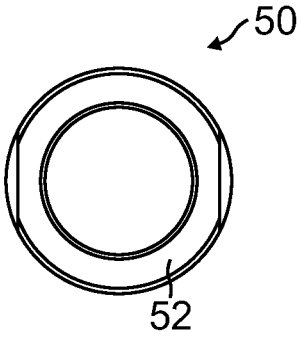
FIG. 12 is a top view of the exemplary plug component of FIG. 8.
Figure 13:
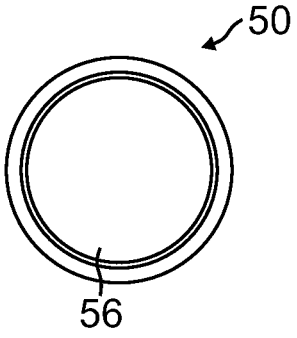
FIG. 13 is a bottom view of the exemplary plug component of FIG. 8.

As shown in this embodiment and seen particularly in FIGS. 5-7, each port 30 is thus offset from the center 32 of the channel 18 of the cyclonic strainer 10. This orientation of the ports 30 imparts a cyclonic rotation on fluids as they pass through the ports 30 and travel northward. Fluids are centrifuged against the interior wall 22 of the cyclonic strainer 10, which directs gas toward the center 32 of the channel 18, allowing the gas to be produced through the channel 18 and to continue northward through the tubing in the direction of the surface.

The south end 16 of the cyclonic strainer 10 can include a tail pipe 34. Preferably, the outer diameter of the cyclonic strainer 10, in the area of the body 14 is greater than the outer diameter of the cyclonic strainer 10 in the area of the tail pipe 34. However, it would be possible to provide a cyclonic strainer 10 in which the outer diameter in the area of the body 14 can be the same as the outer diameter in the area of the tail pipe 34. The tail pipe 34 is adapted to be positioned in fluid in a well. Preferably, when the tail pipe 34 is positioned in such fluid, the fluid level of the well typically reaches a northernmost portion 36 of the tail pipe 34.

Referring now to FIG. 14, a subsurface pump 100 having an embodiment of a cyclonic strainer 10 positioned thereon is shown. In this embodiment, the cyclonic strainer 10 is shown coupled, at its north end 12, to a southern portion of the subsurface pump 100, south of a seating strainer section 126 thereof. In this embodiment, the subsurface pump 100 generally comprises several components. The shaft can be lined with tubing 110. A valve rod or hollow valve rod 112 can pass through or is attached to a rod guide 114, and is coupled at its south end to a plunger adapter 116, which is coupled to a pump plunger 118. The pump plunger 118, in turn, can be coupled to a traveling valve 120, to which is coupled a seat plug 122.

South of the traveling valve 120 is a standing valve 124. South of the standing valve 124 is a seating strainer section 126 and a cyclonic strainer 10 coupled thereto. The portion of the valve rod 112 that passes through or is attached to the rod guide 114, along with the plunger adapter 116, pump plunger 118, traveling valve 120, and seat plug 122 can be positioned within a pump barrel 128. The southern portion of the subsurface pump 100 can be anchored in a southern portion of the tubing 110. One skilled in the relevant art will appreciate that fewer or more components can be added to the subsurface pump 100.

Initially, fluid and gas enter the wellbore from the formation. When the subsurface pump 100 is actuated, fluid and gas migrate from the wellbore to the intake area of the subsurface pump 100, where the cyclonic strainer 10 is situated, which comprises an area of relatively lower pressure than that of the formation. The outer boundary of the gas can naturally have surface tension. In operation, on the upstroke, fluid is drawn into the tail pipe 34 and ports 30 of the cyclonic strainer 10. Gas can also be drawn toward the ports 30.

When the fluid and gas reach the ports 30, the gas can be strained away from the fluid and, as a result of the natural surface tension on the gas, then travels northward, bypassing the ports 30. Although some gas can enter the ports 30, often most of it is separated from the fluid as it enters the ports 30, thereby preventing the gas from entering the subsurface pump 100. The orientation of the ports 30, as discussed above, imparts a cyclonic rotation on fluids as they pass through the ports 30 and travel northward. This cyclonic rotation causes fluid to be centrifuged against the interior wall 22 of the cyclonic strainer 10, which makes way for and allows gas that has entered the ports 30 to be produced through the center 32 of the channel 18, where such gas then travels northward, in the direction of the surface.

Referring now to FIGS. 8-13, a plug component, hereinafter plug 50, is shown. The plug 50 can be utilized with the cyclonic strainer 10. The plug component 50 is adapted to be inserted in a southern portion of the channel 18 of the cyclonic strainer 10 at the south end 16. When utilized with the cyclonic strainer 10, the plug component 50 can regulate fluid intake by blocking the tail pipe 34, thereby closing it off and preventing fluid from entering the cyclonic strainer 10 through the tail pipe 34. In this way, fluid enters the cyclonic strainer 10 only through the ports 30.

The plug component 50 can include a north end 56, a body 54, and a south end 52. The south end 52 can include a hollowed-out portion 58. The body 54 tapers northwardly toward the north end 56, which can permit the plug component 50 to be positioned in the tail pipe 34 of the cyclonic strainer 10. Wrench flats 60 can be provided on the plug component 50, as shown in this embodiment, to assist with positioning the plug component 50 in the tail pipe 34. However, the wrench flats 60 can be omitted. Like the cyclonic strainer 10, the plug component 50 is preferably composed of a hardened material capable of withstanding conditions present in typical well environments. In a preferred embodiment, the plug component 50 is composed of brass. However, other suitable materials can be used for the plug component 50.

Figure 15:
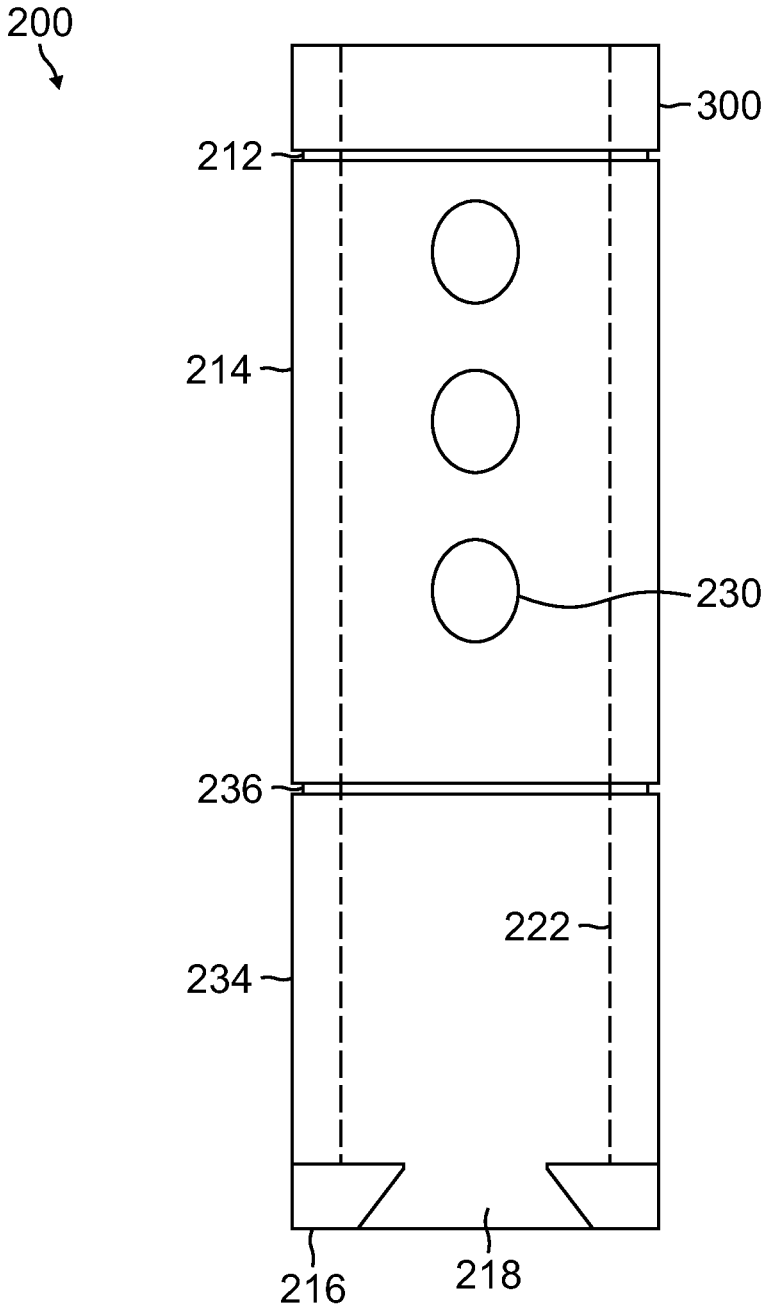
FIG. 15 is side view of an exemplary cyclonic strainer, in accordance with an embodiment of the present application.

Referring now to FIG. 15, another embodiment of a cyclonic strainer device ("cyclonic strainer 200") consistent with an embodiment of the present application is shown. The cyclonic strainer 200 is somewhat similar to the cyclonic strainer 10, but is adapted for use with a naturally flowing gas well.

The cyclonic strainer 200 generally comprises a substantially cylindrical shaped device having a north end 212, a body 214, a south end 216, and a longitudinal channel 218 running therethrough. The cyclonic strainer 200 can be constructed at various lengths, as can be desired for various well configurations and conditions. The body 214 of the cyclonic strainer 200 can include an exterior wall and an interior wall 222. The cyclonic strainer 200 is preferably a one-piece structure, although it can be desired for various components of the cyclonic strainer 200 to be separate pieces that can be coupled together to form a one-piece unit. The cyclonic strainer 200 is preferably composed of a hardened material capable of withstanding conditions present in typical well environments. In a preferred embodiment, the cyclonic strainer 200 is composed of brass. However, other suitable materials can be used for the cyclonic strainer 200.

In one embodiment, the cyclonic strainer 200 is adapted to be coupled, at its north end 212, to a southern portion of a tubing string 300. In such an embodiment, the cyclonic strainer 200 thus forms an intake area. In one embodiment, female threading can be provided proximate the north end 212 of the cyclonic strainer 200 for coupling to the tubing string 300, in similar fashion to the threading 24 utilized on the north end 12 of the cyclonic strainer 10. Alternatively, it can be desired to employ male threading in this region. However, any other suitable coupling means known in the art can be employed for coupling the cyclonic strainer 200 to the tubing string 300.

The body 214 of the cyclonic strainer 200 can include a plurality of ports 230, each of which communicates from the exterior of the cyclonic strainer 200 to the channel 218. The body 214 of the cyclonic strainer 200 can have virtually any number of ports 230, as can be desired for various well configurations and conditions. Preferably, from the perspective of the exterior of the cyclonic strainer 200, each port 230 is angled southwardly or downwardly from the exterior of the cyclonic strainer 200 to the channel 218, in a direction away from a center of the channel 218 of the cyclonic strainer 200, in similar fashion to the orientation of the ports 30 of the cyclonic strainer 10 shown in FIGS. 6 and 7, for example. In one embodiment, each port 230 slopes downwardly at an angle of up to sixty (60) degrees. Likewise, from the perspective of the channel 218, each port 230 is preferably angled northwardly or upwardly from the channel 218 to the exterior of the cyclonic strainer 200.

In another embodiment, each port 230 can slope southwardly or downwardly at an angle ranging from zero (0) up to and including sixty (60) degrees. Such an orientation of the ports 230 allows for a better shear between gas and fluids. In this regard, due to a variety of factors including gravity and the heavier weight of the fluids compared to gas, the gas naturally tends to float upward. The angle of the ports 230 causes fluid to be forced in the opposite direction, resulting in gases and fluids shearing more quickly and cleanly, due to kinetic energy. The angle of the ports 230 could be varied to accommodate different conditions in various well environments, depending upon the nature and severity of any gaseous conditions that can be present. In well environments in which gaseous conditions are extreme, for example, it can be desired for the ports 230 to be sloped southwardly or downwardly at a greater angle than for well environments in which gaseous conditions are not as extreme.

Preferably, each port 230 is thus offset from the center of the channel 218 of the cyclonic strainer 200, in similar fashion to the ports 30 of the cyclonic strainer 10. Such an orientation of the ports 230 imparts a cyclonic rotation on fluids as they are drawn northward through the cyclonic strainer 200 and then northward through the tubing string 300. In this way, fluids are centrifuged against the interior wall 222 of the cyclonic strainer 200, which allows an opening to be created in the center of the channel 218 for gas to escape. Thus, gas is permitted to be produced through the channel 218 and to continue northward through the tubing string 300 in the direction of the surface.

The south end 216 of the cyclonic strainer 10 can include a tail pipe 234. The tail pipe 234 is adapted to be positioned in fluid in a well. Preferably, when the tail pipe 234 is positioned in such fluid, the fluid level of the well reaches a northernmost portion 236 of the tail pipe 34. It is important to note that the cyclonic rotation discussed above also provides a benefit of causing fluids, especially any water present in the formation, to be siphoned slowly into the tail pipe 234, preventing overload from occurring and shutting down production.

In operation, fluid and gas can enter the wellbore from the formation. Natural formation pressure can force such fluid and gas through the cyclonic strainer 200 and northward through tubing string 300. Fluid and gas are first drawn into the tail pipe 234 and ports 230 of the cyclonic strainer 200. When the fluid and gas reach the ports 230, cyclonic rotation imparted by virtue of the orientation of the ports 230 forces the fluid against the interior wall 222 of the cyclonic strainer 200. This cyclonic rotation causes fluid to be centrifuged against the interior wall 222, which makes way for and allows any gas that has entered the cyclonic strainer 200 to be produced through the center of the channel 18, where such gas will then travel northward through the tubing in the direction of the surface.

The foregoing description is provided to enable any person skilled in the relevant art to practice the various embodiments described herein. Various modifications to these embodiments can be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A cyclonic strainer comprising:

an elongated member having a northern end and a southern end, only one channel running longitudinally down a central area of the elongated member;

a plurality of apertures extending through said elongated member into said channel in said central area of said elongated member, wherein the plurality of apertures are angled downwardly at an angle between zero and sixty degrees toward the southern end and away from a center of said channel; and a hollow tail pipe extending from the southern end, wherein the tail pipe has a smaller diameter than the elongated member;

wherein the plurality of apertures are angled to allow gas to be sheared away from fluids to prevent gas from entering the channel through the apertures and to cause gas to travel northward while bypassing the apertures, wherein the plurality of apertures are offset and extend asymmetrically from said center of said channel in order to impart a cyclonic rotation on said fluids as they pass through said apertures and travel northward within said center channel, wherein said apertures are adapted to cause said fluids to flow through said apertures in both a downward direction and an asymmetrical direction from said center of said channel causing the gas to be sheared away from the fluids;

wherein fluid also flows into said channel of said cyclonic strainer through said tail pipe in an upward vertical direction;

wherein said fluid that flows into said channel of said cyclonic strainer through said tail pipe joins with fluid that flows into said channel of said cyclonic strainer through said apertures so that all of said fluid within said channel is centrifuged against an interior wall of said channel; and wherein gas from said fluid that flows through said tail pipe is directed toward said center of said channel and travels northward through said center of said channel.

2. The cyclonic strainer of claim 1, wherein the northern end of said cyclonic strainer is coupled to a southern portion of a seating strainer section of a subsurface pump, the cyclonic strainer thereby forming an intake area of the subsurface pump.

3. The cyclonic strainer of claim 2, wherein said elongated member comprises threading for coupling said cyclonic strainer to said subsurface pump.

4. The cyclonic strainer of claim 3, wherein said threading is on an interior portion of said elongated member.

5. The cyclonic strainer of claim 3, wherein said threading is on an exterior portion of said elongated member.

6. The cyclonic strainer of claim 3, further comprising a shoulder positioned south of said threading.

7. The cyclonic strainer of claim 2, wherein said elongated member comprises a wrench flat for connecting said cyclonic strainer to said subsurface pump.

8. The cyclonic strainer of claim 1, wherein said plurality of apertures are angled up to and including 60 degrees dependent on gas conditions.

9. The cyclonic strainer of claim 1, further comprising a plug component adapted to be inserted into a southern portion of said elongated member.

10. The cyclonic strainer of claim 9, wherein said plug component comprises a wrench flat for coupling said elongated member.

11. An apparatus comprising:

a cylinder with only one channel formed down a central area therein;

a tubing string coupled to a north end of said cylinder;

a plurality of ports on a body of said cylinder angled southward at an angle between zero and sixty degrees to said channel in a direction away from a center of said channel; and a hollow tail pipe coupled to a south end of said cylinder, wherein the tail pipe has a smaller diameter than the elongated member;

wherein the plurality of ports are angled to allow gas to be sheared away from fluids to prevent gas from entering the channel through the ports and to cause gas to travel northward while bypassing the ports, wherein the plurality of apertures are offset and extend asymmetrically from said center of said channel in order to impart a cyclonic rotation on said fluids so that said fluids are centrifuged against an interior wall of said body of said cylinder as they pass through said apertures and travel northward, wherein said apertures are adapted to cause said fluids to flow through said apertures in both a downward direction and an asymmetrical direction from said center of said channel causing the gas to be sheared away from the fluids;

wherein fluid also flows into said channel of said cylinder through said tail pipe in an upward vertical direction;

wherein said fluid that flows into said channel of said cylinder through said tail pipe joins with fluid that flows into said channel of said cylinder through said apertures so that all of said fluid within said channel is centrifuged against said interior wall of said body of said cylinder; and wherein said cyclonic rotation on said fluids also causes gas from said fluid that flows through said tail pipe to be directed toward said center of said channel and travel northward through said center of said channel.

12. The apparatus of claim 11, wherein said north end comprises male threading or female threading for connecting said tubing string.

13. The apparatus of claim 11, wherein said plurality of ports are angled up to and including 60 degrees.

14. The apparatus of claim 11, further comprising a plug component.

15. A cyclonic strainer comprising:

an elongated member having a northern end and a southern end, only one channel running longitudinally down a central area of the elongated member;

a plurality of apertures extending through said elongated member into said channel in said central area of said elongated member, wherein the plurality of apertures are angled downwardly at an angle between zero and sixty degrees toward the southern end and away from a center of said channel; and a hollow tail pipe extending from the southern end, wherein the tail pipe has a smaller diameter than the elongated member;

wherein the apertures have an angle that causes shear between gas and fluids, prevents gas from entering the channel through the apertures, and forces the fluids in an opposite direction from the gas that travels northward while bypassing the apertures, wherein the plurality of apertures are offset and extend asymmetrically from said center of said channel in order to impart a cyclonic rotation on said fluids so that said fluids are centrifuged against an interior wall of said channel as they pass through said apertures and travel northward, wherein said apertures are adapted to cause said fluids to flow through said apertures in both a downward direction and an asymmetrical direction from said center of said channel causing the gas to be sheared away from the fluids, wherein the northern end of said cyclonic strainer is coupled to a southern portion of a seating strainer section of a subsurface pump, the cyclonic strainer thereby forming an intake area of the subsurface pump;

wherein fluid also flows into said channel of said cyclonic strainer through said tail pipe in an upward vertical direction;

wherein said fluid that flows into said channel of said cyclonic strainer through said tail pipe joins with fluid that flows into said channel of said cyclonic strainer through said apertures so that all of said fluid within said channel is centrifuged against said interior wall of said channel; and wherein said cyclonic rotation on said fluids also causes gas from said fluid that flows through said tail pipe to be directed toward said center of said channel and travel northward through said center of said channel.

* * * * *